US008836596B2

(12) United States Patent
Richards et al.

(10) Patent No.: US 8,836,596 B2
(45) Date of Patent: Sep. 16, 2014

(54) FILTER ANTENNA

(71) Applicant: Cubic Corporation, San Diego, CA (US)

(72) Inventors: Wayne Edward Richards, La Mesa, CA (US); Nathan Labadie, San Diego, CA (US)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 14/156,378

(22) Filed: Jan. 15, 2014

(65) Prior Publication Data

US 2014/0198004 A1 Jul. 17, 2014

Related U.S. Application Data

(60) Provisional application No. 61/814,632, filed on Apr. 22, 2013, provisional application No. 61/752,841, filed on Jan. 15, 2013.

(51) Int. Cl.

| | |
|---|---|
| ***H01Q 15/24*** | (2006.01) |
| ***H01P 11/00*** | (2006.01) |
| *H01Q 21/00* | (2006.01) |
| *H01Q 19/00* | (2006.01) |
| *H01P 1/208* | (2006.01) |
| *H01P 1/201* | (2006.01) |

(52) U.S. Cl.

CPC ..... *H01Q 15/24* (2013.01); *H01Q 21/0056* (2013.01); *H01P 11/00* (2013.01); *H01Q 19/005* (2013.01); *H01P 1/2088* (2013.01); *H01P 1/201* (2013.01)

USPC ..... 343/756; 333/202; 333/230; 333/212

(58) Field of Classification Search

CPC ..... H01P 11/00; H01P 1/208–1/2088; H01P 1/201; H01Q 15/24; H01Q 19/005; H01Q 19/028; H01Q 21/0056

USPC ..... 343/756; 333/202

See application file for complete search history.

(56) References Cited

U.S. PATENT DOCUMENTS 5,517,203 A * 5/1996 Fiedziuszko ..... 343/756
2012/0293279 A1 11/2012 Gong et al.

OTHER PUBLICATIONS

Hizan, H.M.; Hunter, I.C.; Abunjaileh, A.I., "Integrated Dual-Band Radiating Bandpass Filter Using Dual-Mode Circular Cavities," Microwave and Wireless Components Letters, IEEE , vol. 21, No. 5, pp. 246,248, May 2011.*

Runqi Zhang; Lei Zhu; Sha Luo, "Dual-Mode Dual-Band Bandpass Filters With Adjustable Frequency RatioUsing an Annular Ring Resonator," Microwave and Wireless Components Letters, IEEE , vol. 23, No. 1, pp. 13,15, Jan. 2013.*

Cheng, et al., "Vertically Integrated Three-Pole Filter/Antennas for Array Applications," *IEEE Antennas and Wireless Propagation Letters,* vol. 10, 2011, pp. 278-281.

(Continued)

*Primary Examiner* — Robert Karacsony
*Assistant Examiner* — Amal Patel
(74) *Attorney, Agent, or Firm* — Kilpatrick Townsend & Stockton LLP

(57) ABSTRACT

A multi-pole filter antenna may include aperture-coupled non-dominant mode cavity resonators, and an aperture-coupled dominant mode patch antenna. The filter antenna may be implemented in a multilayer printed circuit board or similar structure. The filter antenna may for example operate in the Ku-Band, the Ka-Band, the C-Band, or another band.

16 Claims, 8 Drawing Sheets

(56) References Cited

OTHER PUBLICATIONS

Hizan, et al., "Integrated SIW Filter and Microstrip Antenna," *Proceedings of the 40th European Microwave Conference,* Paris, France, Sep. 28-30, 2010, pp. 184-187.

Nadan, et al., "Integration of an Antenna/Filter Device, Using a Multi-Layer, Multi-Technology Process," *28th$^{h}$ European Microwave Conference,* Amsterdam, Netherlands, Oct. 1998, pp. 672-677.

Nova, et al., "An approach to filter-antenna integration in SIW technology," *IEEE,* Univ. of Los Andes, Dept. Of Electrical and Electronic Engineering, Bogota, Columbia, 2011, 4 pages.

Nova, et al., "Filter-Antenna Module Using Substrate Integrated Waveguide Cavities," *IEEE Antennas and Wireless Propagation Letters,* vol. 10, 2011, pp. 59-62.

* cited by examiner

100

200

300

500

600

700

FILTER ANTENNA

CROSS-REFERENCE TO RELATED APPLICATIONS

This application claims the benefit of U.S. Provisional Patent Application No. 61/752,841, filed 15 Jan. 2013, entitled FILTER ANTENNA IN MULTILAYER PRINTED CIRCUIT BOARD (PCB), the entirety of which is incorporated by reference for all intents and purposes.

This application claims the benefit of U.S. Provisional Patent Application No. 61/814,632, filed 22 Apr. 2013, entitled DUAL POLARIZED FILTER ANTENNA USING HIGHER ORDER TM MODE SIW CAVITY RESONATORS, the entirety of which is incorporated by reference for all intents and purposes.

SUMMARY

Integration of filtering and antenna functionality into a single structure using low-cost accessible PCB (Printed Circuit Board) manufacturing processes, to provide a stable polarization reconfigurable radiation pattern for a myriad of applications, such as for example applications where electromagnetic interference and spectral efficiency are of concern. The filter antenna may be single-pole or multi-pole, and may be half-wavelength or larger or smaller in size, the size of which may be determined by principles governing conventional filters and antenna structures. In addition to a radiating element, the filter antenna may include one or more cylindrical cavity resonators defined by RF (Radio Frequency) grade dielectric material bound by metallization and perforated by vias. An annular iris aperture may be used to couple energy from a particular resonator to the radiating element. In a multiple resonator implementation, an annular iris aperture may be used to couple energy between resonators. It is contemplated that the filter antenna may include a two port quadrature hybrid coupler to enable dual channel operation on orthogonal polarizations, or polarization reconfiguration by phase/amplitude weighting of the ports. Although not so limited, an appreciation of the various aspects of the present disclosure may be gained from the following discussion in connection with the drawings.

DETAILED DESCRIPTION

Figure 1:
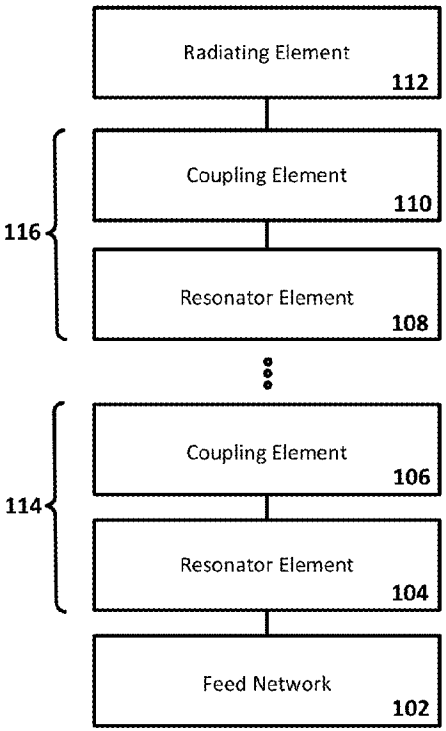
FIG. 1 shows a block diagram of an example filter antenna.

The present disclosure is directed to or towards an antenna that is configured and arranged to function as a single-pole or multi-pole filter. It is contemplated that such an element may for example be incorporated into a phased-array antenna, such as a digitally beam-formed antenna array. A digitally beam-formed antenna array may in some embodiments comprise of hundreds or even thousands of individual antenna elements, and therefore the cost of each antenna element may be of concern, along with the physical size of each antenna element. Further, since filtering is typically a front-end function, for both transmit and receive, and is replicated for each antenna element in a digitally beam-formed antenna array implementation, the cost and size of the circuitry associated with the filtering too may be of concern. Aspects of the present disclosure may be used to integrate, in an economical manner, filtering and antenna functionality into a single structure on a printed circuit board type of substrate.

For example, in one aspect, a substrate integrated filter antenna is disclosed that may include or comprise a cylindrical cavity resonator integrated with or within a particular substrate. The filter antenna may further include or comprise a metallic thin film integrated with or within the particular substrate. The metallic thin film may include an annular iris aperture, and may be coupled in series with the cylindrical cavity resonator. The filter antenna may further include or comprise a circular microstrip patch antenna with or within the particular substrate. The circular microstrip patch antenna may be coupled in series with the annular iris aperture. In one embodiment, the cylindrical cavity resonator may support a $TM_{110}$ mode, and the circular microstrip patch antenna may support a $TM_{11}$ mode. In this example, the filter antenna structure may be used to filter both horizontal and vertical components of a circular polarization. Further, the filter antenna structure may be used to generate two linear polarizations with significant isolation, and ultimately support all orthogonal elliptical polarizations, discussed further below.

In another aspect, a method for fabricating a substrate integrated filter antenna is disclosed. The method may include or comprise forming a stack with or within a particular substrate that includes a cylindrical cavity resonator, a metallic thin film with an annular iris aperture coupled in series with the cylindrical cavity resonator, and a circular microstrip patch antenna coupled in series with the annular iris coupling aperture. In general, the cylindrical cavity resonator may support a $TM_{110}$ mode, and the circular microstrip patch antenna may support a $TM_{11}$ mode. It is however contemplated that the geometry of the filter antenna, along with the materials used to form the filter antenna, may be defined or selected to achieve desired performance or meet desired specifications, discussed further below.

In another aspect, a digitally beam-formed antenna array may include or comprise a plurality of filter antenna elements. Each filter antenna elements may include or comprise a cylindrical cavity resonator integrated within a particular substrate, a metallic thin film with an annular iris aperture integrated with the particular substrate and in series with the cylindrical cavity resonator, and a circular microstrip patch antenna integrated within the particular substrate and in series with the annular iris aperture. In general, the cylindrical cavity resonator may support a $TM_{110}$ mode, and the circular microstrip patch antenna may support a $TM_{11}$ mode. At least one of the plurality of filter antenna elements may however function as a transmitter. Further, at least one of the plurality of filter antenna elements may function as a receiver. In this manner, the filter antenna or filter antenna elements of the present disclosure may be used as a transmit or receive antenna or both simultaneously.

Referring now to FIG. 1, a block diagram of an example filter antenna 100 is shown. The filter antenna 100 may include a feed network 102, a first resonator element 104, a first coupling element 106, a second resonator element 108, a second coupling element 110, and a radiating element 112. The first resonator element 104 and the first coupling element 106 may together be considered or taken as a first pole element 114, and the second resonator element 108 and the second coupling element 110 may together be considered or taken as a second pole element 116. Assuming that the filter antenna 100 consists of only the first pole element 114 and the second pole element 116, the filter antenna 100 may function as a two-pole RF filter. Many other embodiments are possible. For example, the filter antenna 100 may include more or fewer pole elements so as to exhibit more or fewer poles as desired or otherwise realizable.

Each of the resonator elements 104, 108 may correspond to a cylindrical cavity resonator that supports a $TM_{110}$ mode. The $TM_{110}$ mode is not the dominant mode for a cylindrical cavity resonator. Each of the resonator elements 104, 108 may thus be considered a "higher-mode" resonator element. Other embodiments are possible. The radiating element 112 may correspond to a circular microstrip patch antenna that supports a $TM_{11}$ mode. The $TM_{11}$ mode is the dominant mode for a circular microstrip patch antenna. The radiating element 112 may thus be considered a "dominant-mode" radiating element. Other embodiments are possible.

Each of the coupling elements 106, 110 may correspond to an annular iris aperture. In general, an aperture such as an annular iris aperture may be used to couple energy between consecutive in series elements of the filter antenna 100. Specifically, a particular annular iris aperture may serve to couple the two orthogonal cavity modes of a particular resonator element to the two orthogonal cavity modes of a next or adjacent resonator element. For example, the first coupling element 106 may be used to couple energy between the first resonator element 104 and the second resonator element 108. An annular iris aperture as used in the context of the present disclosure is different than a small circular aperture used for electric field coupling in that a circular aperture can only couple a single mode between particular elements via the electric field. Additionally, a particular annular iris aperture may serve to couple the two orthogonal cavity modes of a particular resonator element to the two orthogonal modes or polarizations of a radiating element. For example, the second coupling element 110 may be used to couple energy between the second resonator element 108 and the radiating element 112. Other embodiments are possible.

The feed network 102 may comprise in part of a two-port quadrature hybrid coupling element that may propagate up to two orthogonal polarizations (e.g., 2 linear polarizations, 2 elliptical polarizations, 2 circular polarizations). The feed network 102 may therefore permit a dual circular polarization feed and/or full polarization configurability from linear to circular polarization. For example, a feed to one end of the hybrid coupling element may induce emission by the filter antenna 100 of a RHCP (Right-Hand Circular Polarization) radiation pattern, and a feed to one end of the hybrid coupling element may induce emission by the filter antenna 100 of an a LHCP (Left-Hand Circular Polarization) radiation pattern. Further, when for example both input ports of the hybrid coupling element are excited, phasing and or amplitude may be adjusted or controlled so as to induce emission of any linear to circular polarization by the filter antenna 100, through all ellipticities as desired.

It is contemplated that one or more features of the filter antenna 100 may be implemented differently in order to achieve desired emission and/or filtering characteristics of the filter antenna 100 as discussed throughout. For example, it is contemplated that a particular resonator of the filter antenna 100 may be implemented as one or more resonator structures that exhibit a particular geometry other than a circular or cylindrical geometry (e.g., square, polygonal, etc.) that has sufficient rotational symmetry (e.g., 90 degree) to support at least two orthogonal modes, to excite the radiating element so as to produce two orthogonal polarizations. Amplitude and/or phase weighting of the two orthogonal modes may then allow for realization of emission of any linear to circular polarization, through all ellipticities as desired. Other embodiments are possible.

Additionally, it is contemplated that the annular iris aperture of the filter antenna 100 may be implemented as a number (i.e., greater than one) of circular apertures that are arranged to exhibit sufficient rotational symmetry to couple two orthogonal modes or polarizations between resonators or between a resonator and radiating element. Other embodiments are possible. Further, it is contemplated that the radiating element of the filter antenna 100 may be implemented as an antenna element with a particular geometry other than a circular or cylindrical geometry that has sufficient rotational symmetry to support two orthogonal resonant modes corresponding to two orthogonal radiated polarizations. Other embodiments are possible.

Still further, it is contemplated that the hybrid coupling element of the filter antenna 100 may be replaced with two feed points connected directly to a first resonator. Such a configuration may enable two independent linear polarized channels without additional phase and amplitude weighting at the inputs. In the same manner, use of a hybrid coupling element may enable two independent circularly polarized channels without additional phase and amplitude weighting. However, both configurations are capable of delivering two orthogonally polarized channels with arbitrary polarization assuming the appropriate complex weighting is applied to the inputs of the feed network. Still other embodiments are possible.

Figure 2:
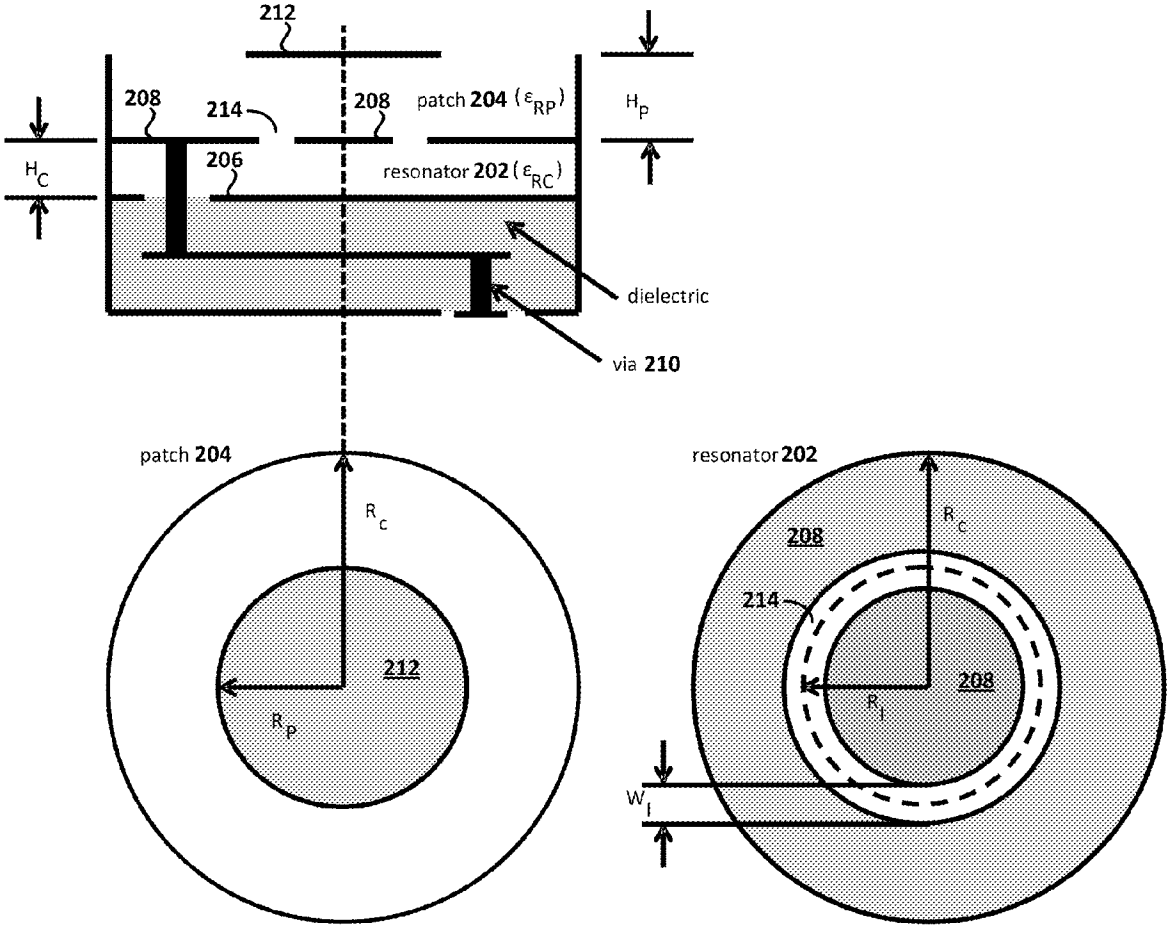
FIG. 2 shows cross-sections of an example filter antenna element.

Referring now to FIG. 2, cross-sections of an example filter antenna element 200 are shown. In this example, the filter antenna element 200 may include a cylindrical cavity resonator 202 that supports at least two orthogonal $TM_{110}$ modes, and a circular microstrip patch antenna 204 that supports a $TM_{11}$ mode. The resonator 202 may include or comprise an RF grade dielectric material bound by a first metallization 206 and a second metallization 208, and perforated by a via 210, similar to a SIW (Substrate Integrated Waveguide) structure. The patch antenna 204 similarly may include or comprise an RF grade dielectric material bound by the second metallization 208 and a third metallization 212. An annular iris aperture 214 may be formed within the second metallization 208 to couple energy from the resonator 202 to the patch antenna 204. Other embodiments are possible.

It is contemplated that a number of design parameters may be defined or selected so as to achieve desired or realizable performance of the filter antenna element 200. For example, the parameter $R_C$, or radius of the resonator 202, may be selected as desired so as to control or otherwise define resonant frequency of the filter antenna element 200. As another example, the parameter $C_{RC}$, or permittivity of the dielectric of the resonator 202, may be selected as desired so as to control or otherwise define resonant frequency of the filter antenna element 200. As another example, the parameter $H_C$, or height of the resonator 202, may be selected as desired so as to control or otherwise define impedance of the filter antenna element 200. Other parameters may be defined or otherwise selected as well to impact performance of the filter antenna element 200.

For example, the parameter $R_I$, or radius of the annular iris aperture 214, may be selected as desired so as to control or otherwise define the coupling of energy between the resonator 202 and the patch antenna 204. As another example, the parameter $W_I$, or width of the annular iris aperture 214, may be selected as desired so as to control or otherwise define the coupling of energy between the resonator 202 and the patch antenna 204. Other parameters may be defined or otherwise selected as well to impact performance of the filter antenna element 200.

For example, the parameter $R_P$, or radius of the patch antenna 204, may be selected as desired so as to control or otherwise define at least one of resonant frequency and pattern gain of the filter antenna element 200. As another example, the parameter $H_P$, or height of the patch antenna 204, may be selected as desired so as to control or otherwise define at least one of directivity, efficiency, and bandwidth of the filter antenna element 200. As another example, the parameter $\in_{RP}$, or permittivity of the patch antenna 204, may be selected as desired so as to control or otherwise define resonant frequency of the filter antenna element 200. It is contemplated that still other parameters may be defined or otherwise selected as well to impact performance of the filter antenna element 200.

Figure 3:
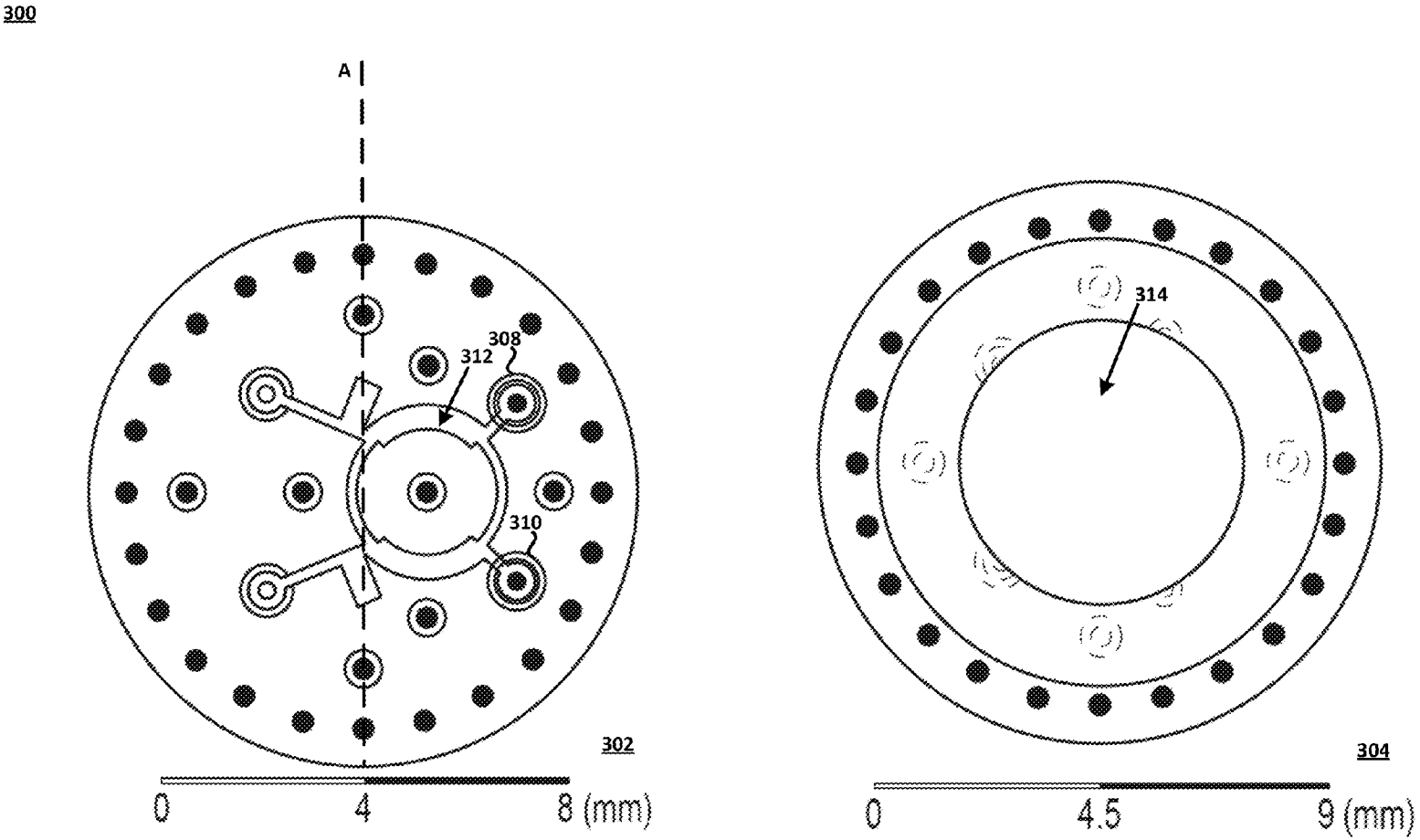
FIG. 3 shows a bottom view and a top view of a multilayer PCB comprising an example multiple-pole filter antenna.
Figure 4:
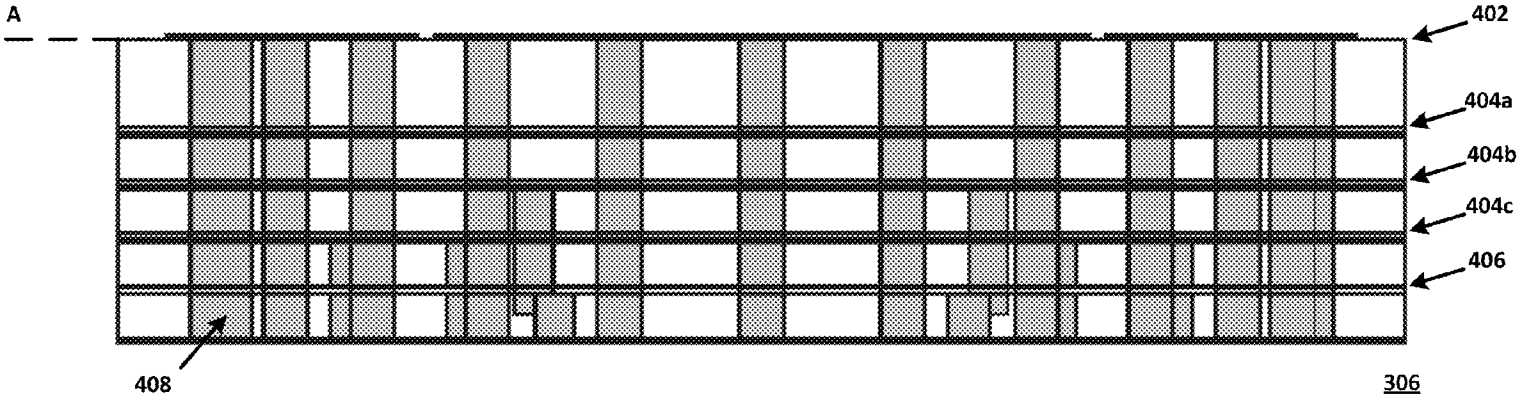
FIG. 4 shows a cross-section of the filter antenna of FIG. 3.

Referring now to FIG. 3 and FIG. 4, a bottom view 302, a top view 304, and a cross-sectional view 306 of a multilayer PCB comprising an example multiple-pole filter antenna 300 is shown. In particular, the bottom view 302 of FIG. 3 shows a first port 308 and a second port 310 of a quadrature hybrid coupler 312 of the filter antenna 300, and the top view 304 of FIG. 3 shows a radiating patch 314 of the filter antenna 300. Other components of the filter antenna 300 are integrated with or within the multilayer PCB. For example, the profile or cross-sectional view 306 of FIG. 4, taken along an axis A (see also FIG. 3), generally shows a core/bond/metallization stack-up of the filter antenna 300 including a patch layer 402, a plurality of cavity layers 404*a-c*, a hybrid layer 406, and a plurality of cavity resonator vias 408. In this example, the filter antenna 300 is a 3-pole filter antenna. Other embodiments are possible.

Figure 5:
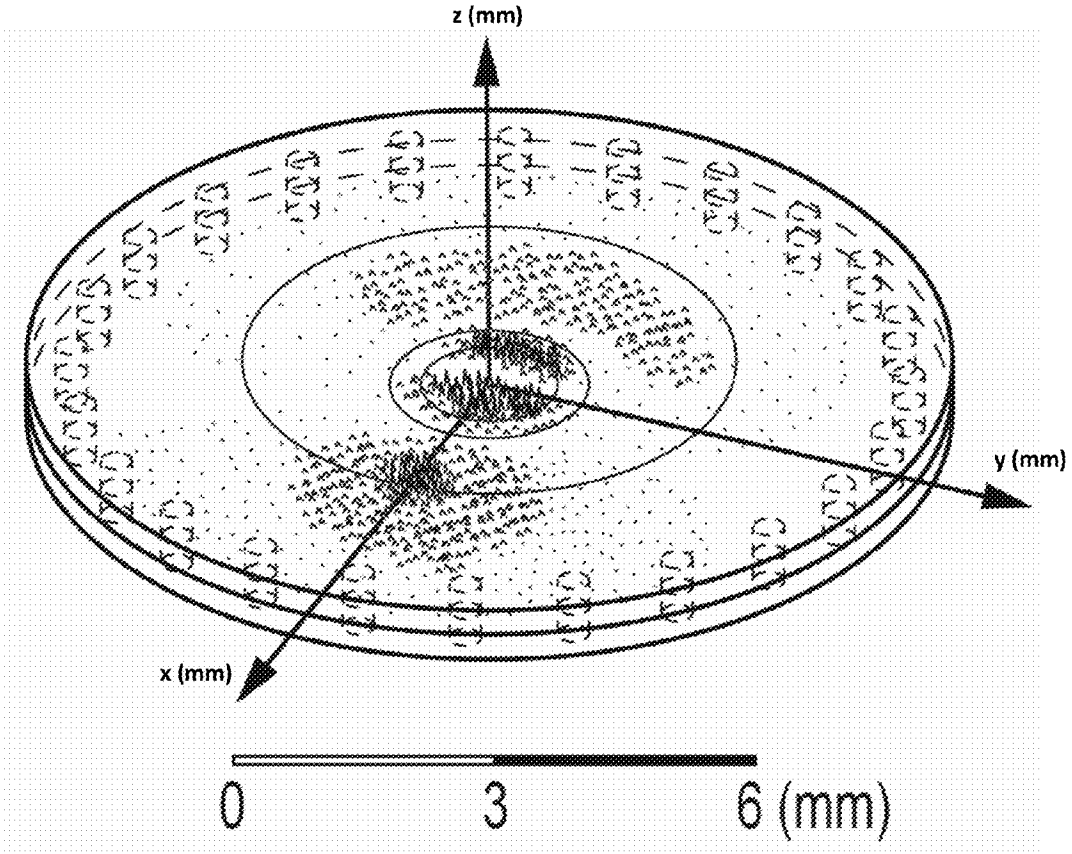
FIG. 5 shows a simulation of a $TM_{110}$ cylindrical resonator cavity mode for the filter antenna of FIG. 3.
Figure 6:
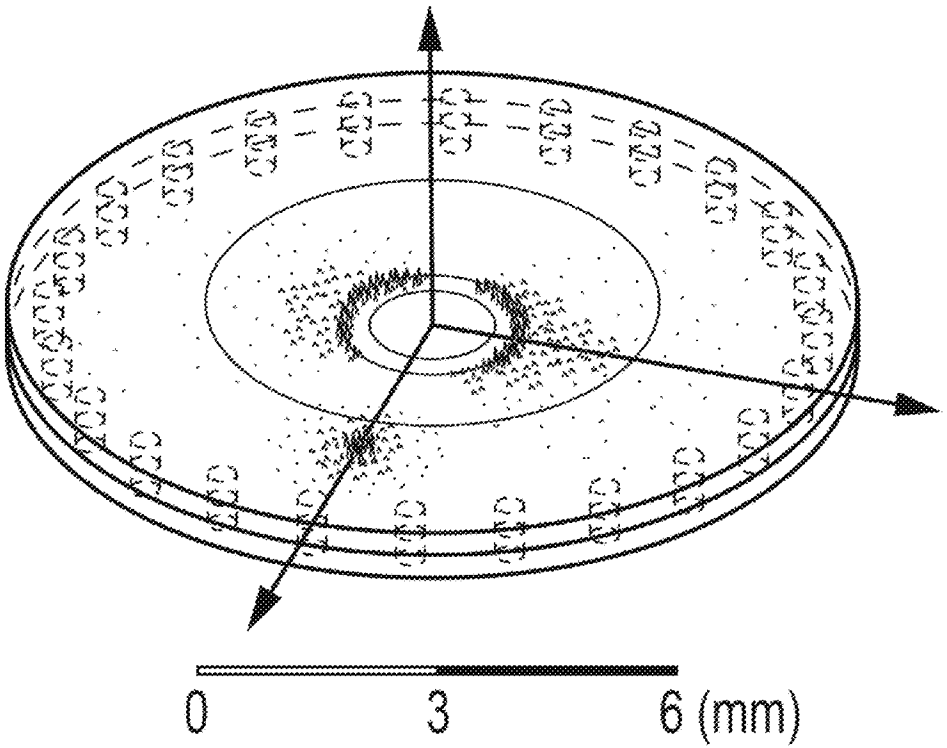
FIG. 6 shows a full wave electromagnetic simulation of induced dipole current excitation along an annular iris aperture of the filter antenna of FIG. 3.
Figure 7:
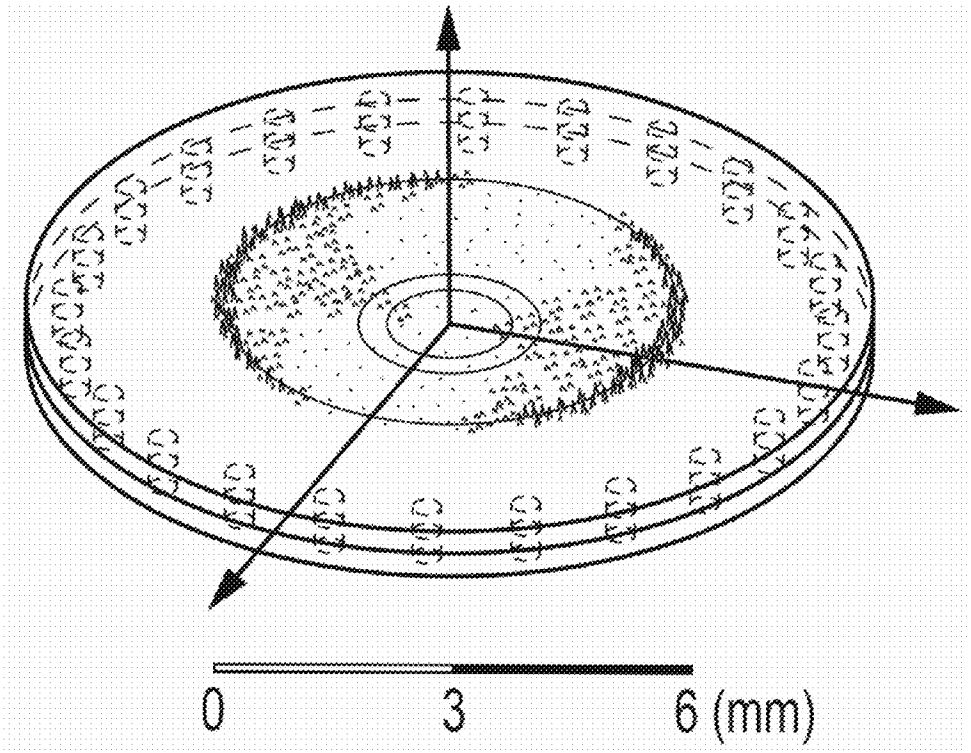
FIG. 7 shows a full wave electromagnetic simulation of an induced $TM_{11}$ patch antenna mode for the filter antenna of FIG. 3.

Referring now to FIGS. 5-8, a number of full wave electromagnetic simulations associated with the filter antenna 300 of FIGS. 3-4 are shown. In particular, FIGS. 5-7 taken together illustrate inducement of a $TM_{11}$ patch antenna mode radiated by the filter antenna 300. Specifically, a simulation 500 of FIG. 5 shows a $TM_{110}$ cylindrical resonator cavity mode (via+ground plane defined cavity) for the filter antenna 300. As shown by the simulation 500, the $TM_{110}$ cylindrical cavity mode is indicated by the two lobes of high density markers distributed with a 180 degree rotational symmetry. The density of markers corresponds to the strength of the electric field within the cavity. Conceptually, the field is rising on one end of an associated cylindrical cavity resonator of the filter antenna 300 and falling on the other end of the cylindrical cavity resonator. For circular polarization, the field as shown by the simulation 500 rotates in time, in a circle. This rotating field excites a magnetic current along an annular iris aperture of the filter antenna 300 adjacent the cylindrical cavity resonator. This is illustrated by a simulation 600 of FIG. 6 that shows induced dipole current excitation along an annular iris aperture of the filter antenna 300 of FIG. 3. In this example, the dipolar excitation of the annular iris aperture is indicated by the two concentrations of high current density which are tangential to the annular iris aperture and directed in opposite angular orientation. The annular iris aperture ultimately serves to couple energy between the cylindrical cavity resonator of the filter antenna 300 and a circular microstrip patch antenna of the filter antenna 300, to induce a $TM_{11}$ patch antenna mode radiated by the filter antenna 300 in operation. This is illustrated by a simulation 700 of FIG. 7 that shows an induced $TM_{11}$ patch antenna mode for the filter antenna 300 of FIG. 3. In this example, the TM11 circular patch mode is indicated by the two concentrations of high current density which are tangential to the perimeter of the circular patch and directed in opposite angular orientation. Other embodiments are possible.

Figure 8:
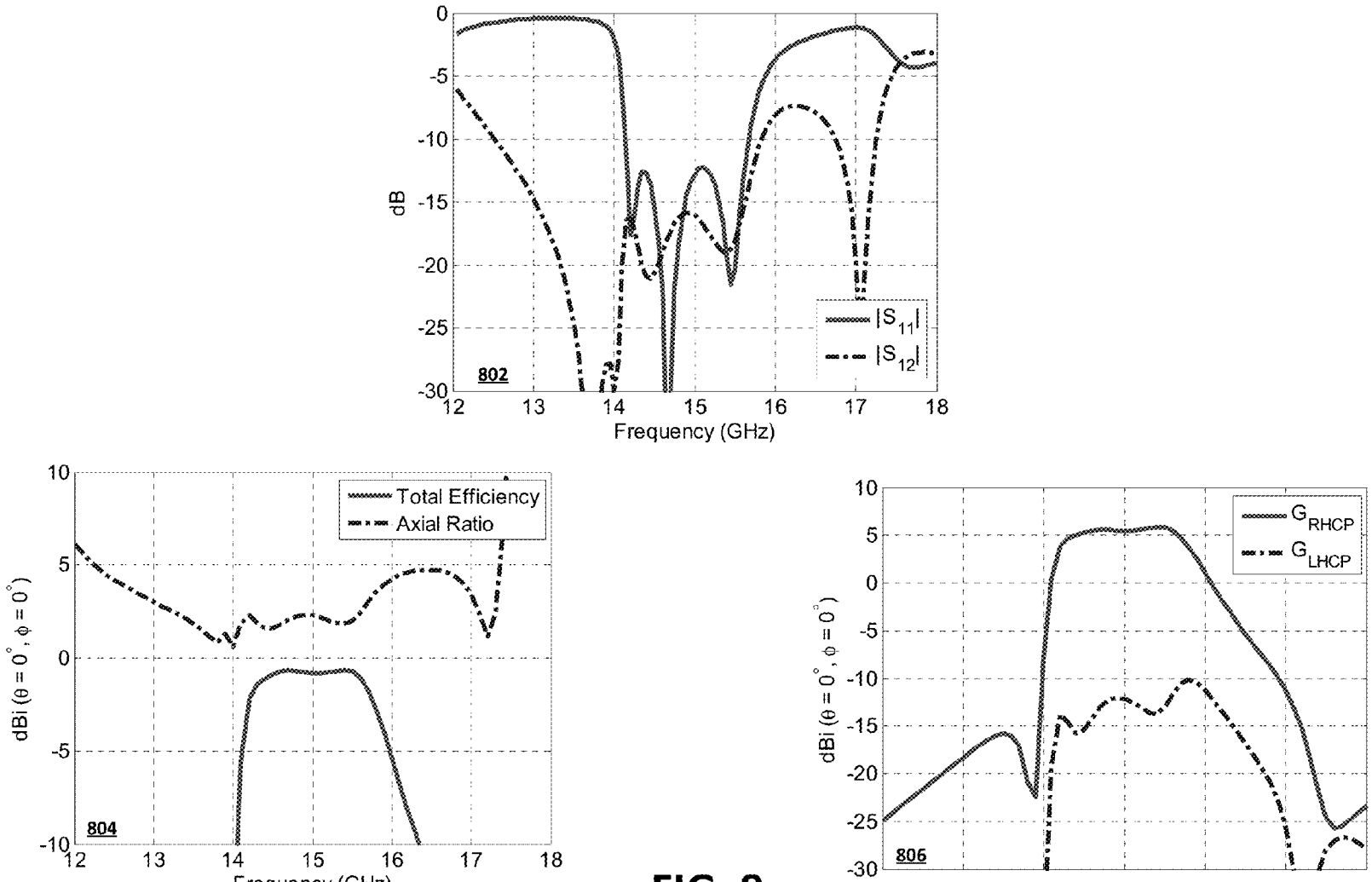
FIG. 8 shows full wave electromagnetic simulation plots demonstrating performance of the filter antenna of FIG. 3.

Referring now specifically to FIG. 8, a number of full wave electromagnetic simulation plots demonstrating performance of the filter antenna 300 of FIG. 3 are shown. In particular, a first plot 802 of $|S_{11}|$ and $|S_{12}|$ illustrates wide matching bandwidth to accommodate fabrication tolerances (about 14.1 GHz to about 15.7 GHz). In this example, the input ports correspond to the first port 308 and the second port 310, and $|S_{11}|$ represents input reflection coefficient and $|S_{12}|$ represents isolation between the two input ports. A second plot 804 of axial ratio and efficiency indicates less than 3 dB axial ratio across band and total efficiency greater than −1 dB (about 80%) across the impedance matching bandwidth. Further, a third plot 806 of RHCP realized gain and LHCP gain realized illustrates less than 1 dB of passband gain ripple across the impedance matching bandwidth.

As may be understood from the foregoing, embodiments of the present disclosure include a filter antenna to provide a stable polarization reconfigurable radiation pattern with well-defined frequency filtering characteristics. The filter antenna may be utilized in applications where electromagnetic interference and spectral efficiency are of concern, and where a high level of device level integration is desired. Embodiments of the present disclosure integrate filtering into the antenna element such that they are tightly electromagnetically coupled. Among other things, advantages may include low cost and usage of readily available PCB manufacturing processes, which lend themselves well to mass production.

The features or aspects of the present disclosure may be beneficial and/or advantages in many respects. For example, the filter antenna of the present disclosure may allow for propagation of two independent modes through one filter antenna structure, compactly supporting filtering of both components of circular modulation. Furthermore, embodiments may allow dual polarization operation (i.e., right-hand circular polarization and/or left-hand circular polarization) thereby reducing system complexity, good matching between filtering characteristics on the two polarization components, and/or full polarization reconfiguration from linear to circular (i.e. any elliptical polarization is realizable) in a small, low-cost structure.

Furthermore, embodiments can be utilized in a variety of applications, including, without limitation communication and data links antenna arrays with highly constrained bandwidth requirements: spectral mask (transmit) and tolerance to interfering signals (receive); antenna applications where physical space in the RF chain is highly constrained (e.g., filter is embedded in a low-profile multilayer PCB antenna board; communication and data link antenna arrays requiring real-time polarization reconfiguration or dual channel operation on orthogonal polarizations. Other benefits and/or advantages are possible as well. For example, the filtering characteristics, phase shift characteristics, gain characteristics, etc., of the two different mode paths tend to match each other well since the same physical structure (and materials) is used for both channels. Accordingly, the filter antenna of the present disclosure may more accurately produce polarizations (e.g., linear, elliptical, circular) as desired.

It is contemplated that other structures are within the scope of the present disclosure. For example, separate dominant mode filter structures per polarization which are coupled to the radiating element may be used. Such an approach however would require an increased footprint area and may increase element separation distance in an array implementation. Further, there also may be reduced symmetry in the excitation of the radiating element resulting in beam pattern asymmetry and higher cross-polarization levels. The aspects of the present disclosure addresses these and other issues.

The methods, systems, and devices discussed throughout are examples. Various configurations may omit, substitute, or add various method steps or procedures, or system components as appropriate. For instance, in alternative configurations, methods may be performed in an order different from that described, and/or various stages may be added, omitted, performed simultaneously, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A substrate integrated filter antenna, comprising:

a uniformly cross-sectioned cylindrical cavity resonator integrated with a substrate and that supports two degenerate orthogonal modes of at least type $TM_{110}$;

a thin film with a uniformly circular annular iris aperture integrated with the substrate and in series with the cylindrical cavity resonator; and a circular microstrip patch antenna integrated with the substrate in series with the annular iris aperture and that a least supports a type $TM_{11}$ mode.

2. The filter antenna of claim 1, further comprising a multi-port quadrature hybrid coupler in series with the cylindrical cavity resonator.

3. The filter antenna of claim 1, wherein the substrate comprises a printed circuit board.

4. A method for fabricating a substrate integrated filter antenna, comprising:

forming a stack within a substrate that includes a uniformly cross-sectioned cylindrical cavity resonator that supports two degenerate orthogonal modes of at least type $TM_{110}$, a thin film with a uniformly circular annular iris aperture that is in series with the cylindrical cavity resonator, and a circular microstrip patch antenna that is in series with the annular iris coupling aperture and that at least supports a type $TM_{11}$ mode.

5. The method of claim 4, further comprising forming the cylindrical cavity resonator to exhibit a particular radius to control resonant frequency of the filter antenna.

6. The method of claim 4, further comprising forming the cylindrical cavity resonator from a particular dielectric material to control resonant frequency of the filter antenna.

7. The method of claim 4, further comprising forming the cylindrical cavity resonator to exhibit a particular height to control impedance of the cylindrical cavity resonator.

8. The method of claim 4, further comprising forming the annular iris aperture to exhibit a particular radius to control coupling of energy between the cylindrical cavity resonator and circular microstrip patch antenna.

9. The method of claim 4, further comprising forming the annular iris aperture to exhibit a particular width to control coupling of energy between the cylindrical cavity resonator and circular microstrip patch antenna.

10. The method of claim 4, further comprising forming the circular microstrip patch antenna to exhibit a particular radius to control at least one of resonant frequency and pattern gain of the filter antenna.

11. The method of claim 4, further comprising forming the circular microstrip patch antenna to exhibit a particular height to control at least one of directivity, efficiency, and bandwidth of the filter antenna.

12. The method of claim 4, further comprising forming the circular microstrip patch antenna from a particular dielectric material to control resonant frequency of the filter antenna.

13. A digitally beam-formed antenna array, comprising:

a plurality of filter antenna elements each including a uniformly cross-sectioned cylindrical cavity resonator integrated with a particular substrate and that supports two degenerate orthogonal modes of at least type $TM_{110}$, a metallic thin film with a uniformly circular annular iris aperture integrated with the particular substrate and in series with the cylindrical cavity resonator, and a circular microstrip patch antenna integrated with the particular substrate in series with the annular iris aperture and that at least supports a type $TM_{11}$ mode.

14. The antenna array of claim 13, wherein at least one of the plurality of filter antenna elements further includes a plurality of annular iris coupled cylindrical cavity resonators so that the at least one filter antenna element is a multi-pole filter antenna.

15. The antenna array of claim 13, wherein at least one of the plurality of filter antenna elements is a transmitter antenna.

16. The antenna array of claim 13, wherein at least one of the plurality of filter antenna elements is a receiver antenna.

* * * * *

UNITED STATES PATENT AND TRADEMARK OFFICE

CERTIFICATE OF CORRECTION

PATENT NO. : 8,836,596 B2
APPLICATION NO. : 14/156378
DATED : September 16, 2014
INVENTOR(S) : Richards et al.

It is certified that error appears in the above-identified patent and that said Letters Patent is hereby corrected as shown below:

In the Claims:

Column 7, line 41, please delete "a least" and insert --at least--.

Signed and Sealed this
Third Day of March, 2015

Michelle K. Lee

Michelle K. Lee
*Deputy Director of the United States Patent and Trademark Office*